US006336554B1

(12) United States Patent
Brühwiler

(10) Patent No.: US 6,336,554 B1
(45) **Date of Patent: *Jan. 8, 2002**

(54) LOCKABLE TAMPERPROOF BOX

(75) Inventor: Othmar Brühwiler, Elgg (CH)

(73) Assignee: Pataco AG, Elgg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,865

(22) PCT Filed: Oct. 23, 1997

(86) PCT No.: PCT/CH97/00400

§ 371 Date: Jul. 21, 1999

§ 102(e) Date: Jul. 21, 1999

(87) PCT Pub. No.: WO98/17883

PCT Pub. Date: Apr. 30, 1998

(30) Foreign Application Priority Data

Oct. 23, 1996 (CH) ..... 2594/96

(51) Int. Cl.[7] ..... B65D 85/575

(52) U.S. Cl. ..... 206/308.2; 206/387.11; 206/1.5; 206/807

(58) Field of Search ..... 206/1.5, 308.2, 206/387.11, 807; 70/63

(56) References Cited

U.S. PATENT DOCUMENTS 4,932,526 A * 6/1990 Nehl et al. ..... 206/1.5
5,147,034 A 9/1992 Broadhead et al. ..... 206/1.5
5,209,086 A * 5/1993 Bruhwiler ..... 70/63
5,524,752 A 6/1996 Mazzucchelli ..... 206/308.2
5,588,315 A * 12/1996 Holmgren ..... 70/63

FOREIGN PATENT DOCUMENTS

| | | | |
|---|---|---|---|
| DE | 295 07 538 | 5/1995 | |
| EP | 0 508 201 | 3/1992 | |
| EP | 0 451 189 B1 | 10/1992 | ..... G11B/33/04 |
| EP | 0 508 201 B1 | 8/1995 | ..... B65D/50/14 |
| FR | 2 688 483 | 9/1993 | |
| WO | WO 94/09234 | 4/1994 | |

* cited by examiner

*Primary Examiner*—David T. Fidei
(74) *Attorney, Agent, or Firm*—Morgan, Lewis & Bockius LLP

(57) ABSTRACT

A lockable tamperproof box for retailing a product which requires a special tool to unlock, whereby a rear part of a locking device is pushed into a lock-in position when the product is inserted into an insertion aperture in the box in the direction of insertion and whereby a front part of locking device is equipped with a locking element for the insertion aperture, comprises the front part having the form of a sheath, and rear part having the form of a rod, wherein the rear part engages in a cam follower of the front part by means of a catch cam, and the front part is rotated about the direction of insertion by forced coupling with the rear part into a position with the locking element in the insertion aperture when the product is inserted.

10 Claims, 5 Drawing Sheets

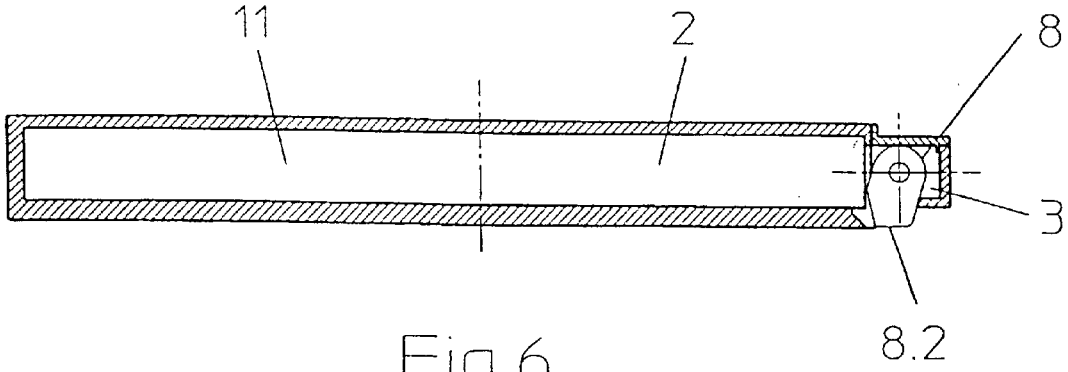
Fig.6
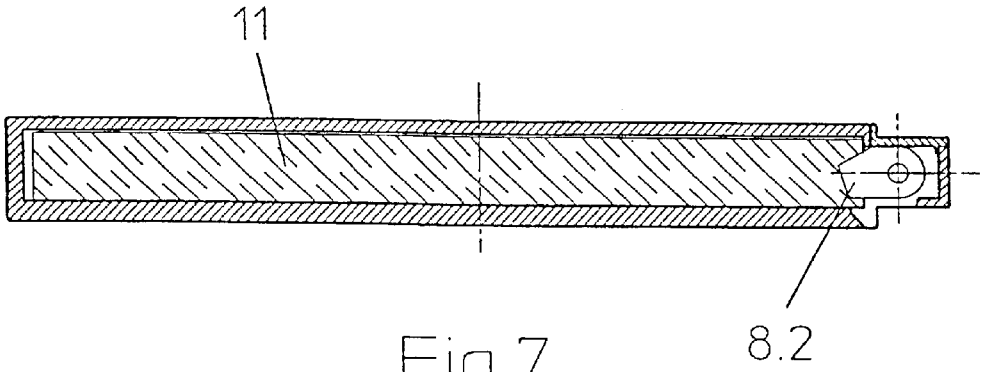
Fig.7
Fig.8a)
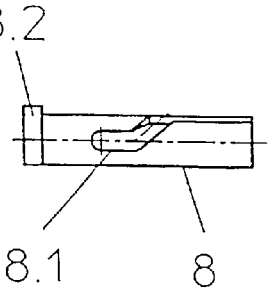
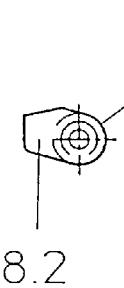
Fig.8b)
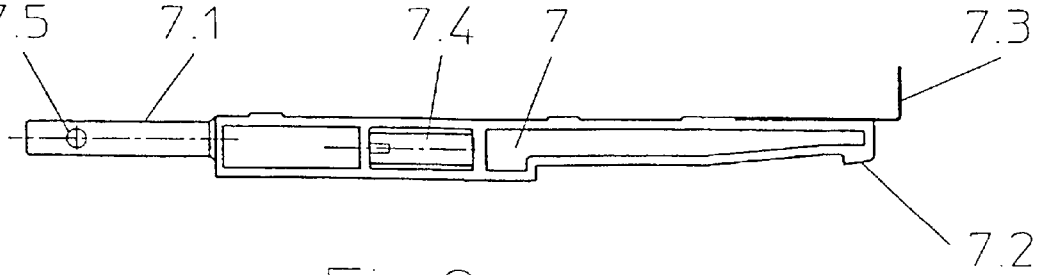
Fig.9

LOCKABLE TAMPERPROOF BOX

TECHNICAL FIELD

The invention refers to a lockable tamperproof box for sales presentation of compact disk cassettes, audio tape cassettes, video cassettes or the like, which requires a special tool to unlock it. Boxes of this kind are also described in technical jargon as "Safers". The invention refers in particular to a tamperproof box in which, when the cassette is inserted into an insertion aperture of the box, a rear part of a locking device is shifted in the direction of insertion into a lock-in position and in which a front part of this device is equipped with a locking element for the insertion aperture.

Lockable tamperproof boxes of this kind are generally provided internally with electronically or magnetically remotely detectable elements, such as e.g. resonance labels, and are used in retail outlets that are equipped with the related detection systems for the purpose of theft prevention. Any attempt to steal a cassette together with the tamperproof box causes the detectable element inside the tamperproof box to be detected and an alarm to be set off. In the case of a regular purchase, however, the cassettes are removed by the sales staff with a special tool from the tamperproof box, which can then be filled again and re-used.

In order to serve their purpose, tamperproof boxes must not add too much to the cassettes, i.e. they must not be too voluminous, must enable the cassettes they contain to be easily recognised, and yet must on the other hand surround the cassettes so firmly and securely that any unauthorised removal of the cassette or of a data or music medium contained therein is not readily possible. In order to be repeatedly useable, they must be sufficiently robust and, as they are required in large quantities, they must also be cheap. Cassette insertion and extraction operations should be as simple as possible.

STATE OF THE ART

A tamperproof box of the kind described at the beginning is known for example from EP 0 508 201 B1. In this case, the locking device comprises a flexible one-piece, bow-shaped accessory element made of magnetic material, which is provided with a longitudinal slit along one of the narrow sides of the box wall conducted between two longitudinally movable terminal buffers and with limbs protruding inwards at both ends, by which the cassette is gripped clamp-wise during insertion and also while it remains inserted. When the cassette is inserted, a locking catch on the inner or rear end of the accessory element is engaged in a slit in the box housing. A strong magnet is necessary to open this locking device, while the cassette is pulled out together with the accessory element at the same time. In the position of the external or front terminal buffer, the extremity of the accessory element protruding from the box can be bent outwards when the clamp around the cassette is freed. It is also necessary to bend the element outwards in the same way when the box is filled. The known tamperproof box is preferably self-locking.

In the tamperproof box known from EP 0 451 189 B1, on the other hand, it is necessary to lock the locking device affixed to it on the outside after the cassette has been inserted by hand, using an external bolt. If this operation is overlooked, the cassette remains unprotected.

In both of the known embodiments, it is relatively simple to lock the box unintentionally without any cassette having been inserted. In the case of the tamperproof box as per EP 0 508 201 B1, this is because the external end of the accessory element protrudes from the cassette. In the case of the box as per EP 0 451 189 B1 A, the bolt described is necessarily freely accessible.

DISCLOSURE OF INVENTION

It is the task of the invention to provide a tamperproof box for cassettes that satisfies the demands already described and is also self-locking. In addition, it should also be possible to fill the box automatically in an easy manner and to avoid unintentional locking without any cassette having been inserted. This task is fulfilled by equipping a tamperproof box of the type named at the beginning with a front part that, when the cassette is inserted, is rotated about the direction of insertion by forced coupling with the rear part into a position in which the locking element is swivelled into the insertion aperture.

If no cassette is inserted into the box, the locking element is swivelled out of the insertion aperture, which remains completely free. This enables the box to be filled e.g. letting the cassette drop directly from above into the open insertion aperture, a process that can easily be automated.

As the front part of the locking device takes the form of a swivel component that only rotates when the rear part situated deeper in the box is activated, no part of the locking device protrudes from the box when it is empty and also no actuating element of this device is externally accessible. Any unintentional locking of the locking device is thus avoided.

The box according to the invention is preferably divided into two chambers, one of which has the purpose of holding the cassette and the other of housing the locking mechanism.

The forced coupling between the rear and the front part may take the form of a connecting device, whereby the front part preferably takes the form of a sheath and the rear part preferably takes the form of a rod and the rear part engages the front part with a cam follower in a guiding connection.

In one preferred embodiment, the rear part can be caught into the lock-in position by means of a catch element, whereby the catch element is preferably a leaf spring made of magnetic material clamped on one side into one wall of the box, whose free end automatically connects into a lock catch formed on the rear part when the rear part is pushed into the catch position.

In order to facilitate removal of a cassette from the tamperproof box, the rear part can be pre-loaded by a spring against the direction of insertion opposite the box housing. The spring is loaded further when a cassette is pushed in. As a further advantage, the spring holds the locking device open when the box is empty, i.e. not locked, that that it can be filled instantly.

The width of the chamber that receives the cassette can be chosen substantially to equal the width of the insertion aperture. This embodiment offers the possibility of forming the locking element as an arm, connected to the rotating front part, that swivels into the insertion aperture behind a cassette when it is inserted in the direction of insertion.

An alternative embodiment offers the option to choose the width of the chamber that houses the cassette slightly larger than the width of the insertion aperture. In this case, the locking element can be formed as a catch, connected to the rotating front part, that swivels into the insertion aperture next to the cassette when it is inserted.

For the purpose of displaying the cassettes to the best advantage, the chamber that houses the cassette should be formed at least partly transparent and/or partly open to the exterior. The chamber containing the locking device then has a preferably closed form on the outside and is not transparent, in order to render unauthorised handling and any understanding of the locking mechanism more difficult.

BRIEF EXPLANATION OF THE FIGURES

The aim of the following is to explain the invention further, with the aid of embodiments taken in relation with the Figures, which show:

FIG. 6 a cross-section through the empty box;

FIG. 7 a cross-section through the full box;

FIG. 8 a side view below a) and a frontal view under b) of the front part shaped as a curved sheath of the locking device of the box;

FIG. 9 a view of the rear part of the locking device; and

WAYS OF CARRYING OUT THE INVENTION

Figure 1:
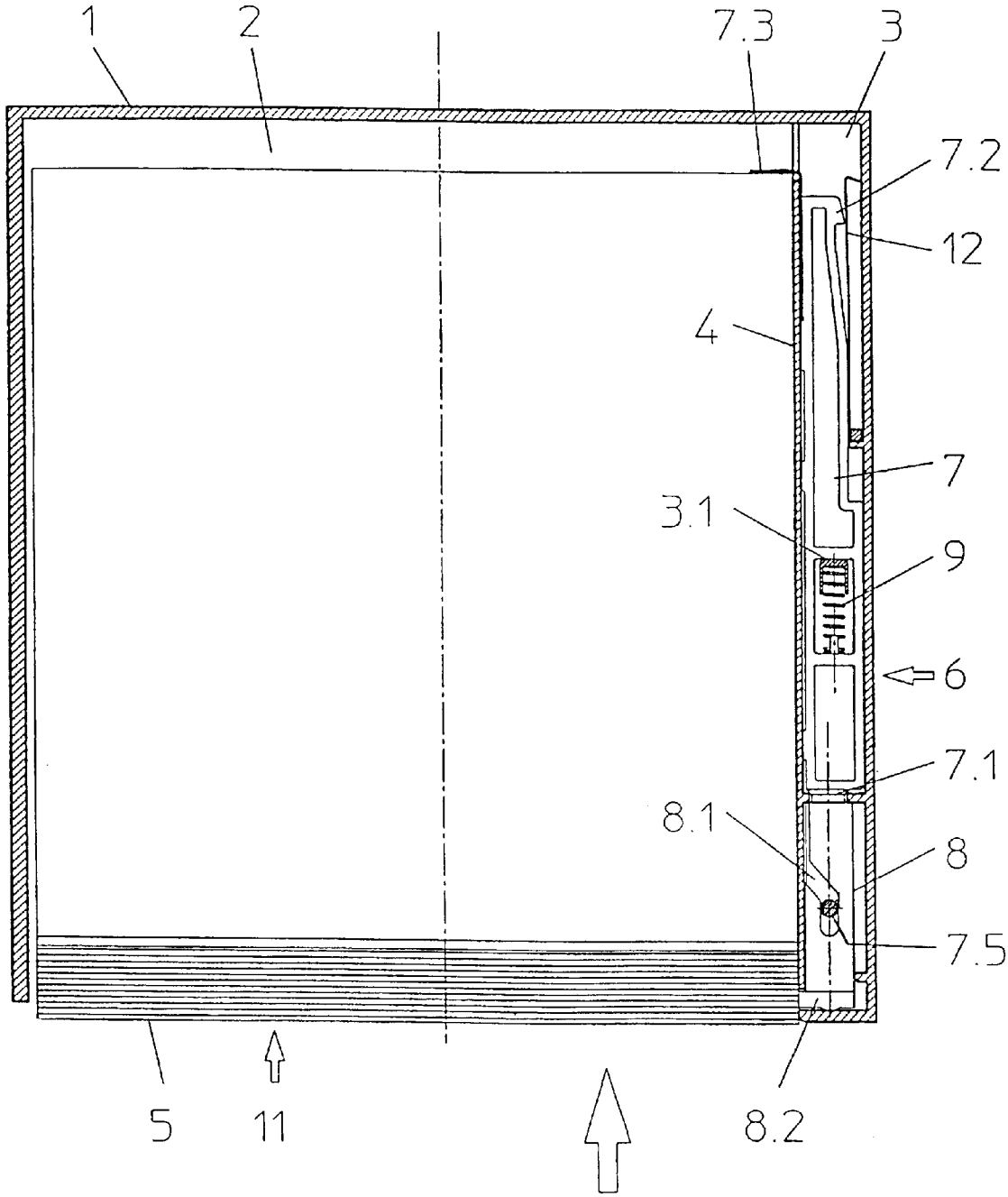
FIG. 1 a horizontal cross-section of a tamperproof box according to the invention in a first embodiment with a partly inserted cassette.

The tamperproof box 1 in FIG. 1 has two chambers 2 and 3, which are separated by a partition wall 4. A CD cassette 5 is pushed part of the way into the larger chamber 2 in the direction of the arrow illustrated (direction of insertion). The smaller chamber 3 contains a locking device 6, which comprises a rear part 7 and a front part 8.

The rear part 7, illustrated separately in FIG. 9, is approximately rod-shaped and fed into chamber 3 so that it can be pushed longitudinally, whereby a terminal buffer is formed by a rib in the housing 3.1. FIG. 1 shows the rear part 7 at this terminal buffer. The front section 7.1 of the rear part 7 has a round cross-section. Furthermore, an angled element with a limb 7.3 protruding inwards into the larger chamber 2 is fixed there. In the central area of the rear part, there is a housing 7.4 for a spring 9, which is supported by the aforementioned housing ribbing 3.1 and holds the rear part 7 open against the direction of insertion of the cassette 5 or holds it pre-loaded in the position illustrated against the front terminal buffer similarly formed by the housing ribbing 3.1.

The front part 8 of the locking device 6 illustrated separately in FIG. 8 is a round sheath, which is applied to the round front terminal section of the rear part 7. The sheath 8 is equipped with a connecting link 8.1, which is engaged by a pin 7.5 recessed into the front terminal section 7.1 of the rear part 7. Furthermore, the sheath 8 is lodged in chamber 3 so that it can rotate around its longitudinal axis without changing position and is equipped at its front end with a laterally protruding eccentric arm 8.2. The connecting link 8.1 is formed in such a way that, when the rear part 7 is pushed longitudinally, the front part 8 is forced to rotate by the engaging connection described above. The two parts 7 and 8 of the locking device are thus forcefully coupled.

As already mentioned, FIG. 1 shows the rear part 7 of the locking device 6 at its front terminal buffer. In this position, the sheath 8 is turned in such a way that the arm 8.2 is swivelled out of the range of the insertion aperture 11 of the larger chamber 2, as shown in FIG. 6. In this case, the width of the insertion aperture 11 is the same as the width of the chamber 2 and chosen to comply with the width of the cassette.

Figure 2:
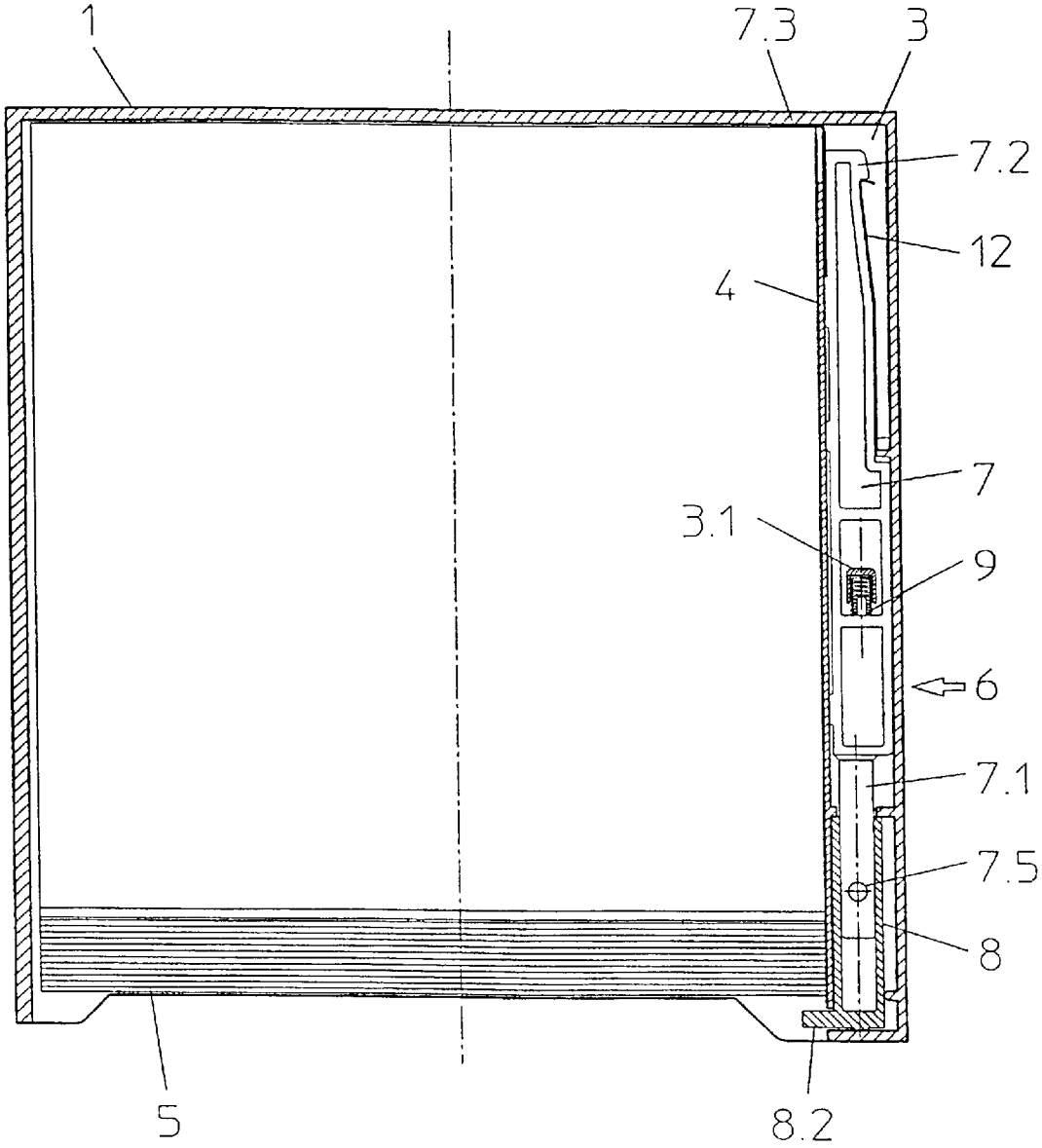
FIG. 2 the box with the cassette fully inserted and locked.

If the cassette 5 is pushed from its position as shown in FIG. 1 in the direction indicated by the arrow completely into the tamperproof box 1 or its larger chamber 2, it takes the rear part 7 of the locking device 6 with it in the process, as the angle element fixed thereto seizes a corner of the cassette with its limb 7.3. The spring 9 is also loaded further by this process, until the catch element 7.2 on the rear part 7 of the locking device 6 catches onto the free end of a leaf spring 12 clamped on one side into one wall of the box. The leaf spring 12 is pre-loaded in such a way that its free end springs automatically under the catch element 7.2 as soon as it has been pushed far enough in the direction of insertion. It is made of a magnetic material. FIG. 2 shows the box 1 with the cassette 5 pushed fully home, in addition to the catching mechanism as described.

When the rear part 7 of the locking device is pushed, its front part 8 is forced to rotate, so that the arm 8.2 on the front part 8 swivels in the direction of insertion behind the cassette 5 in the area of the insertion aperture 11. FIG. 7 shows the sheath 8 in this rotated position with the arm 8.2 in the insertion aperture. In this position, the cassette 5 can no longer be removed from the box 1.

In order to remove the cassette from the box 5, the catch between the leaf spring 12 and the catch element 7.2 must first be freed. This is achieved by means of a strong magnet, with which the free end of the leaf spring 12 is pulled away from under the catch element 7.2. As this can be achieved from outside and it is not necessary to intervene inside the chamber 3, this latter may have a completely closed form towards the outside.

Once the catch mehanism has been freed, the locking arm 8.2 is swivelled back out of the area of the insertion aperture 11 under the effect of the loaded spring 9, after which a part of the cassette 5 is expelled from the box 1, so that it can be gripped easily.

Figure 3:
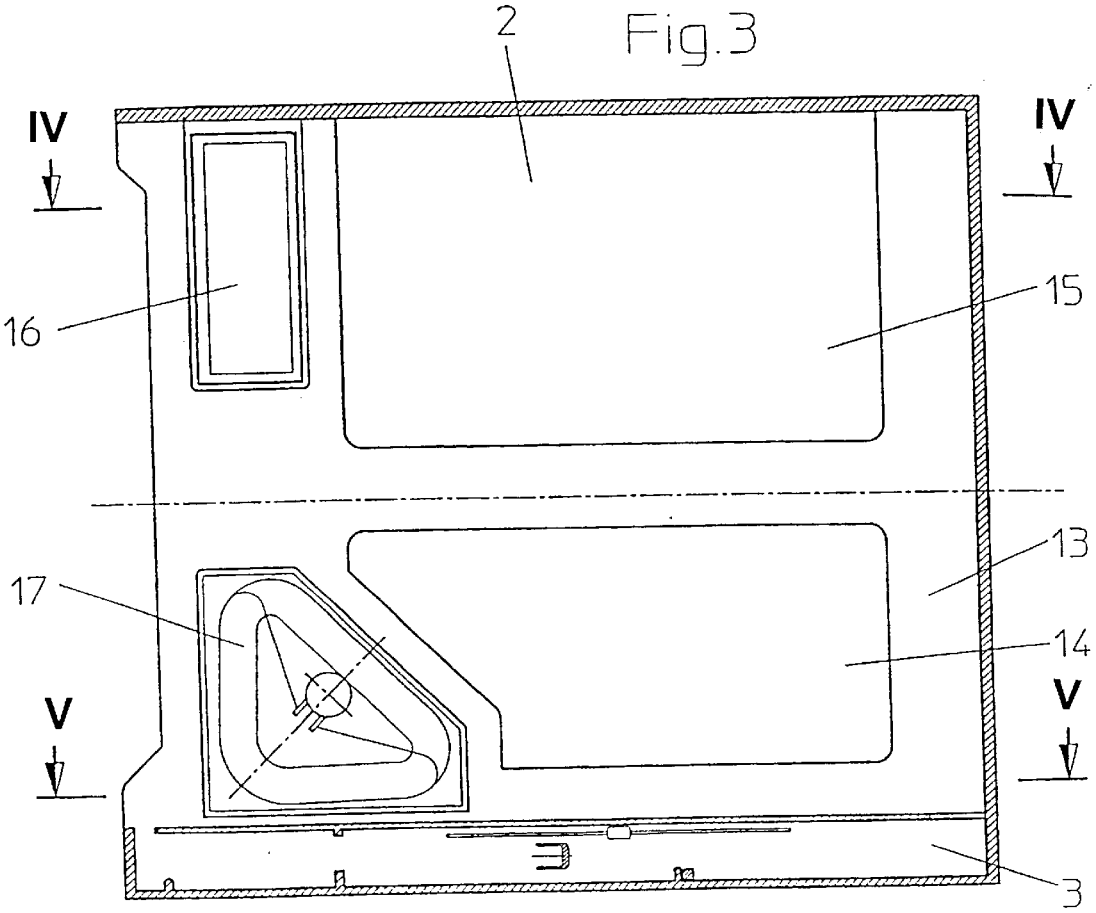
FIG. 3 the same box, from which the cassette and the locking device have been removed.
Figure 4:
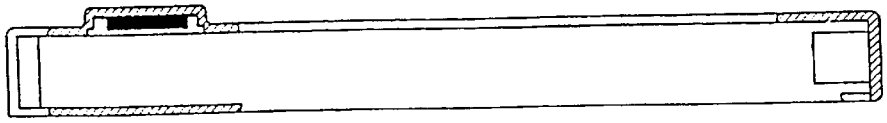
FIG. 4 section A—A from FIG. 3.
Figure 5:
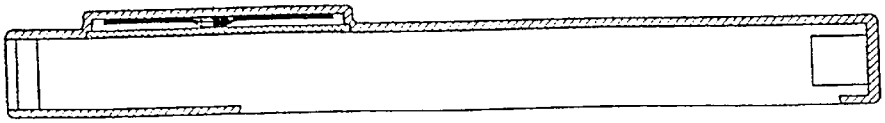
FIG. 5 a section B—B from FIG. 3.

The construction of the base of the box 1 according to the invention can be recognised with the aid of FIG. 3. The base 13 does not have a closed form, but comprises window-like apertures 14 and 15. The front side, which cannot be seen, may have a fundamentally similar form. Nevertheless, two electronically detectable resonance labels 16 and 17 can be recognised on the inner side of the base, although one such remotely detectable element would suffice. Further details of the box wall construction can be identified in FIGS. 4 and 5.

Figure 10:
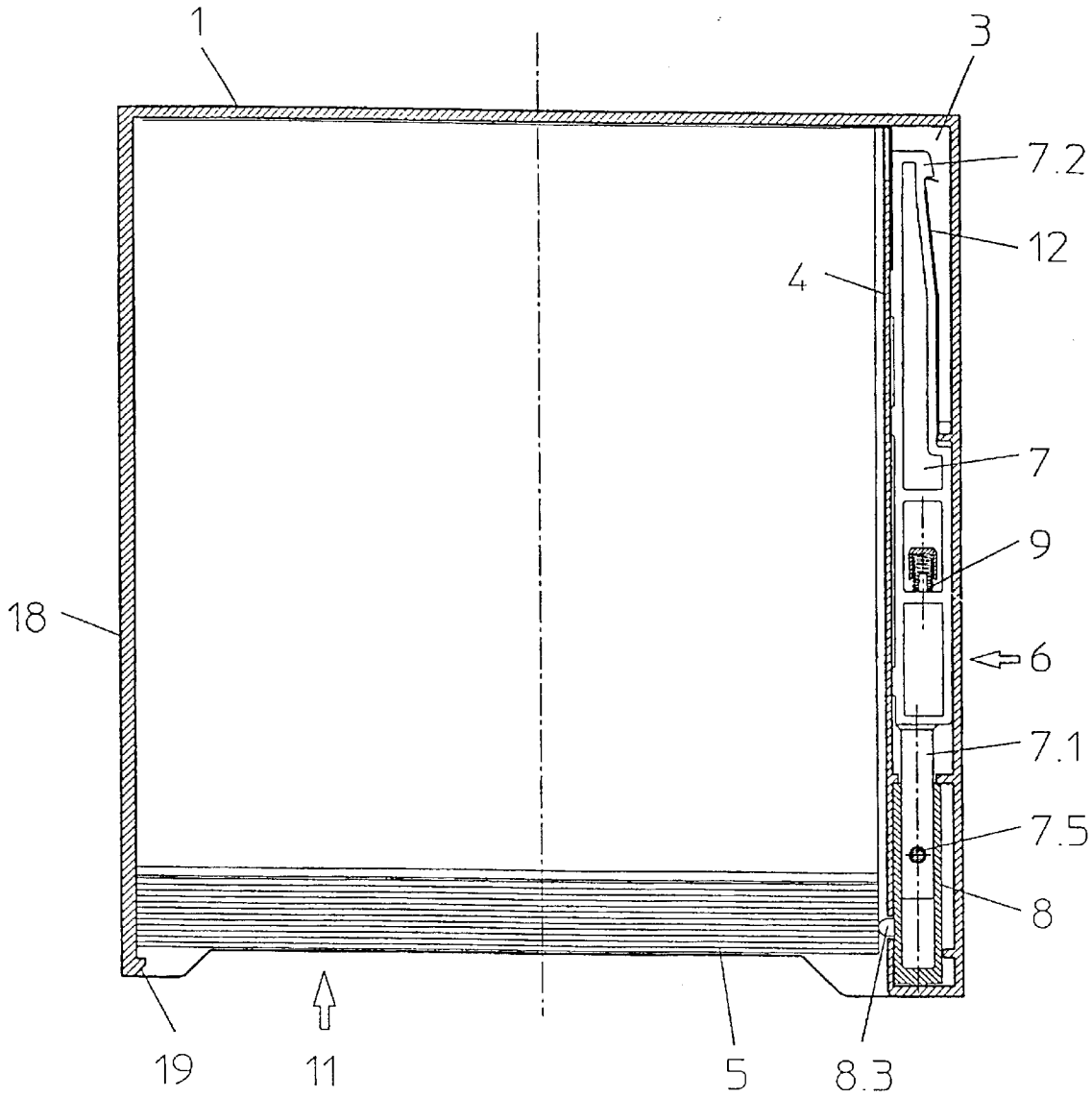
FIG. 10 an illustration according to FIG. 2 of a further embodiment of a box according to the invention.

FIG. 10 shows an embodiment in which the width of the chamber 2 that houses the cassette has been chosen to be somewhat greater than the width of the cassette. By continuing the side wall 18 onto the narrow front side of the box or by forming a sort of gate 19, however, the width of the aperture 11 remains limited to the width of the cassette, just as before. Instead of the arm 8.2 (or at least in addition to it), this embodiment also entails a laterally protruding cam on the sheath-shaped front part 8 of the locking device 6. This swivels in alongside the cassette 5 when the cassette is pushed into the box 1 and forces it against the box wall 18 opposite. Also in this case, once the catch element has caught, the cassette can no longer be removed from the box, as it is imprisoned behind the gate 19.

What is claimed is:

1. A lockable tamperproof box for retailing a product which requires a special tool to unlock the box, whereby a rear part of a locking device is pushed into a lock-in position when the product is inserted into an insertion aperture in the box in the direction of insertion and whereby a front part of the locking device is equipped with a locking element for the insertion aperture, wherein the front part has the form of a sheath, the rear part has the form of a rod, the rear part engages a cam follower of the front part of a catch cam, and the front part is rotated about the direction of insertion by forced coupling with the rear part into a position with the locking element in the insertion aperture when the product is inserted.

2. A tamperproof box according to claim 1, wherein the tamperproof box is divided into two chambers, whereby the purpose of one of the two chambers is to house the product and the other contains the locking device.

3. A tamperproof box according to claim 1, wherein the rear part can be engaged in the catch position by a catch element, whereby the catch element is a spring leaf made of magnetic material clamped on one side into one wall of the box, whose free end automatically engages with a catch formed on the rear part when the rear part is pushed into the lock-in position.

4. A tamperproof box according to claim 1, wherein the rear part is pre-loaded by a spring against the direction of insertion.

5. A tamperproof box according to claim 2, wherein a width of the chamber for housing the product complies substantially with a width of the insertion aperture and that the locking element has the form of an arm, connected to the rotating front part, that can swivel behind the product into the insertion aperture when the product is inserted in the direction of insertion.

6. A tamperproof box according to claim 2, wherein a width of the chamber for housing the product is greater than a width of the insertion aperture and that the locking element has the form of a cam, connected to the rotating front part, that can swivel behind the product into the insertion aperture when the product is inserted in the direction of insertion.

7. A tamperproof box according to claim 2, wherein the chamber for housing the product is at least partly transparent and/or partly open to the outside, while the chamber containing the locking device is closed to the outside and not transparent.

8. A tamperproof box according to claim 1, wherein the tamperproof box is equipped with an electronic remote detection element.

9. A tamperproof box according to claim 1, wherein the tamperproof box is equipped with an electromagnetic remote detection element.

10. A lockable tamperproof box according to claim 1, wherein the product includes compact disk cassettes, audio tape cassettes, or video cassettes.

* * * * *